US006928961B2

(12) United States Patent
Pan et al.

(10) Patent No.: US 6,928,961 B2
(45) Date of Patent: Aug. 16, 2005

(54) LIQUID HEATING DEVICE

(76) Inventors: Huang Chuan Pan, P.O. Box 2-10, Tainan City (TW); Huang Chen-Lung, P.O. Box 2-10, Tainan City (TW)

( * ) Notice: Subject to any disclaimer, the term of this patent is extended or adjusted under 35 U.S.C. 154(b) by 0 days.

(21) Appl. No.: 10/406,998

(22) Filed: Apr. 3, 2003

(65) Prior Publication Data

US 2003/0219241 A1 Nov. 27, 2003

Related U.S. Application Data

(63) Continuation-in-part of application No. 10/157,471, filed on May 23, 2002, now Pat. No. 6,705,252.

(51) Int. Cl.[7] ..... F22B 27/08
(52) U.S. Cl. ..... 122/40; 392/399
(58) Field of Search ..... 122/4 A, 4 D, 122/40, 235.29, 247, 451.2, 195; 392/394, 396, 397, 399, 400

(56) References Cited

U.S. PATENT DOCUMENTS 4,246,871 A * 1/1981 Bocksruker et al. ..... 122/4 A
6,018,615 A * 1/2000 Loblick ..... 392/397
6,430,760 B2 * 8/2002 Johns ..... 4/598
6,748,904 B1 * 6/2004 Chiang ..... 122/40

* cited by examiner

*Primary Examiner*—Gregory Wilson

(57) ABSTRACT

A liquid heating device includes a pump for pumping liquid, and a helical heating tube receiving liquid sent by the pump. The two ends of the helical heating tube are connected with two terminals of electric power, and when a control system is started, the helical heating tube is heated up to produce high heat to heat up the liquid therein to a proper temperature, to boil it up or change it into vapor for practical use.

1 Claim, 4 Drawing Sheets

LIQUID HEATING DEVICE

FIELD OF THE INVENTION

This invention is continued-in-part of Ser. No. 10/157,471 filed on May 23, 2002 U.S. Pat. No. 6,705,252 capable to heat up liquid speedily to a proper temperature or to boil it or change it into vapor, and applicable to a drink water dispenser, a heater or any equipment for heating liquid.

BACKGROUND OF THE INVENTION

A common conventional liquid heating device generally includes a cast block 1 made of zinc-aluminum alloy and an electric heating tube 10 and a water conveying tube 11 both contained in the cast block 1. Then the cast block 1 is heated up by the electric heating tube 10, and then the water conveying tube 11 is heated up by the heat of the cast block 1 so that liquid flowing in the water conveying tube 11 is also heated up to become airy vapor. The time required in vaporizing may be 2–3 minutes at least or more than ten minutes at latest depending on the capacity of the electric heating tube 10. If liquid in the tube 11 is to be vaporized in two or three minutes, the heating tube should be large enough to heat up swiftly and accordingly use a large amount of electricity. If liquid is to be heated up in 10–20 minutes, the heating tube can be small to use small amount of electricity, but it takes time, not convenient to use.

The conventional liquid heating device described above uses the electric heating tube 10 for indirectly heating liquid flowing through the water conveying tube 11, having inferior effect in vaporizing due to insufficient heat capacity so that liquid drops may remain at the outlet of the water conveying tube 11, hardly meeting the using standard.

The U.S. Pat. No. 4,246,871 has a water heater 10 surrounding a chamber 20, which then helically located around an outlet 30 so that the water heater 10 may heat the water in the chamber 20. So it is complicated, attaining its object and effect by processing the chamber 20 to surround the water heater 10.

Next, U.S. Pat. No. 5,058,194 has a heating tube 14, and an electric resistance 17 wound on the surface of the heating tube 14. The electric resistance 17 produces high temperature to heat the water in the heating tube 14, impossible to produce steam instantly, as it is an indirect heating mode.

SUMMARY OF THE INVENTION

This invention has been devised to offer a liquid heating device capable to produce vapor quickly, applicable to various industries.

The liquid heating device in the invention has the following feature.

1. It includes a pump for pumping liquid into a helical heating tube, which has its two ends connected to two output terminals of an a control system, When the control system is started, the helical heating tube is powered to product high heat to heat up at once the liquid therein to a proper temperature, or boil up or vaporize it by managing the control system.

2. The liquid heating device in the invention utilizes the helical heating tube, with the temperature at the inlet being the lowest and that nearer to the outlet becoming higher and higher so that the liquid pressure at the inlet may not flow back to the pump so as to make the liquid flowing smooth.

DETAILED DESCRIPTION OF THE INVENTION

Figure 1:
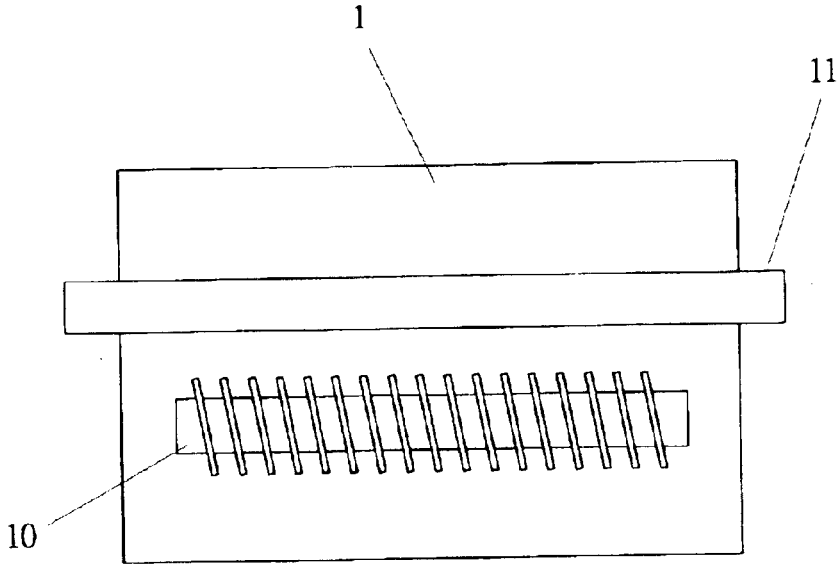
FIG 1 (PRIOR ART)
FIG. 1 is a side view of a conventional liquid heating device.
Figure 2:
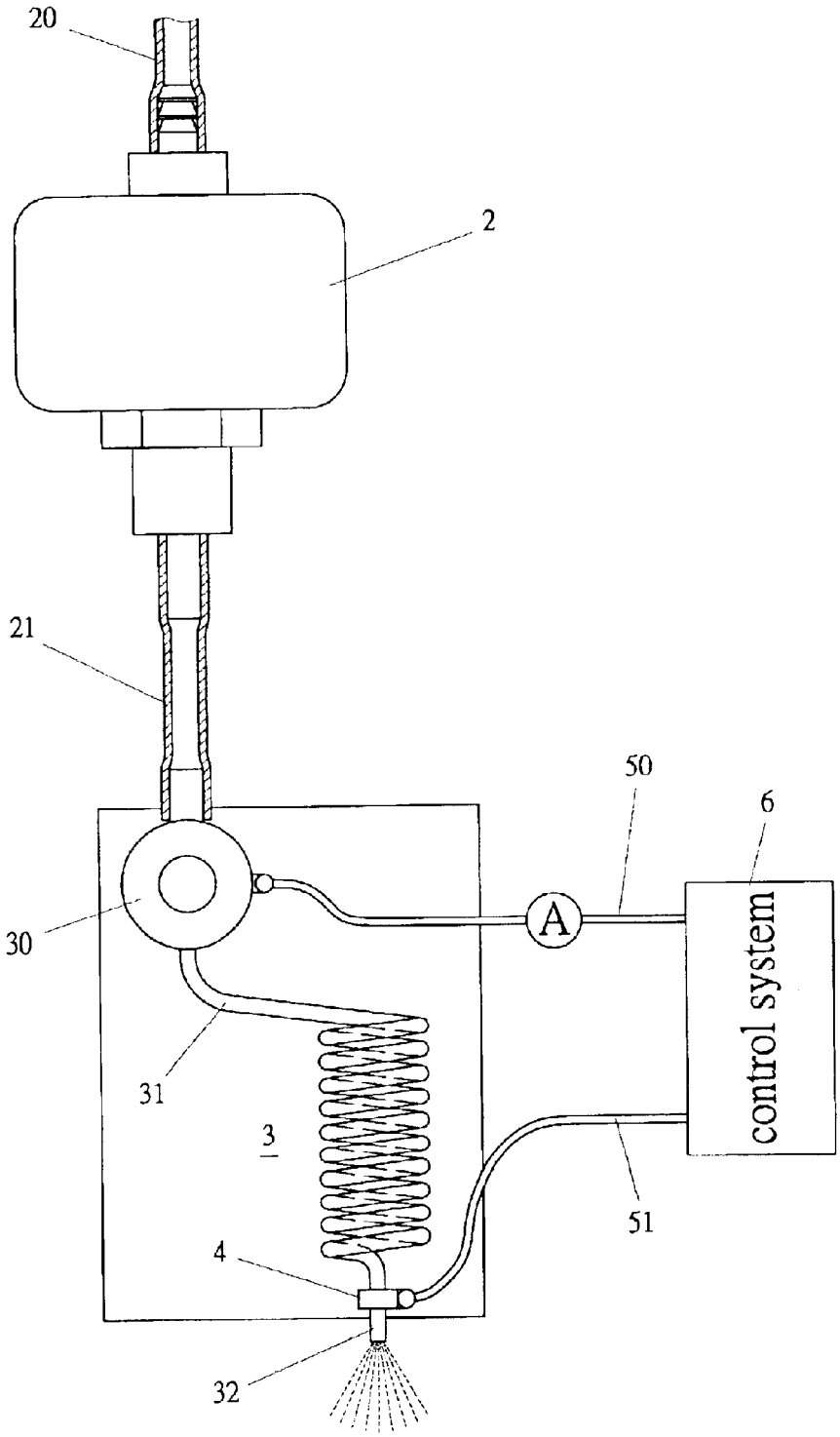
FIG. 2 is a perspective view of a liquid heating device in the present invention.

A preferred embodiment of a liquid heating device in the present invention, as shown in FIG. 2, includes a pump 2, a heating tube 3 and a control system 6 as main components combined together.

The pump 2 has an inlet tube 20 fixed on a side of the pump 2 for pumping in liquid in a liquid store tank (not shown), and an outlet tube 21 connected to the heating tube 3.

Figure 3:
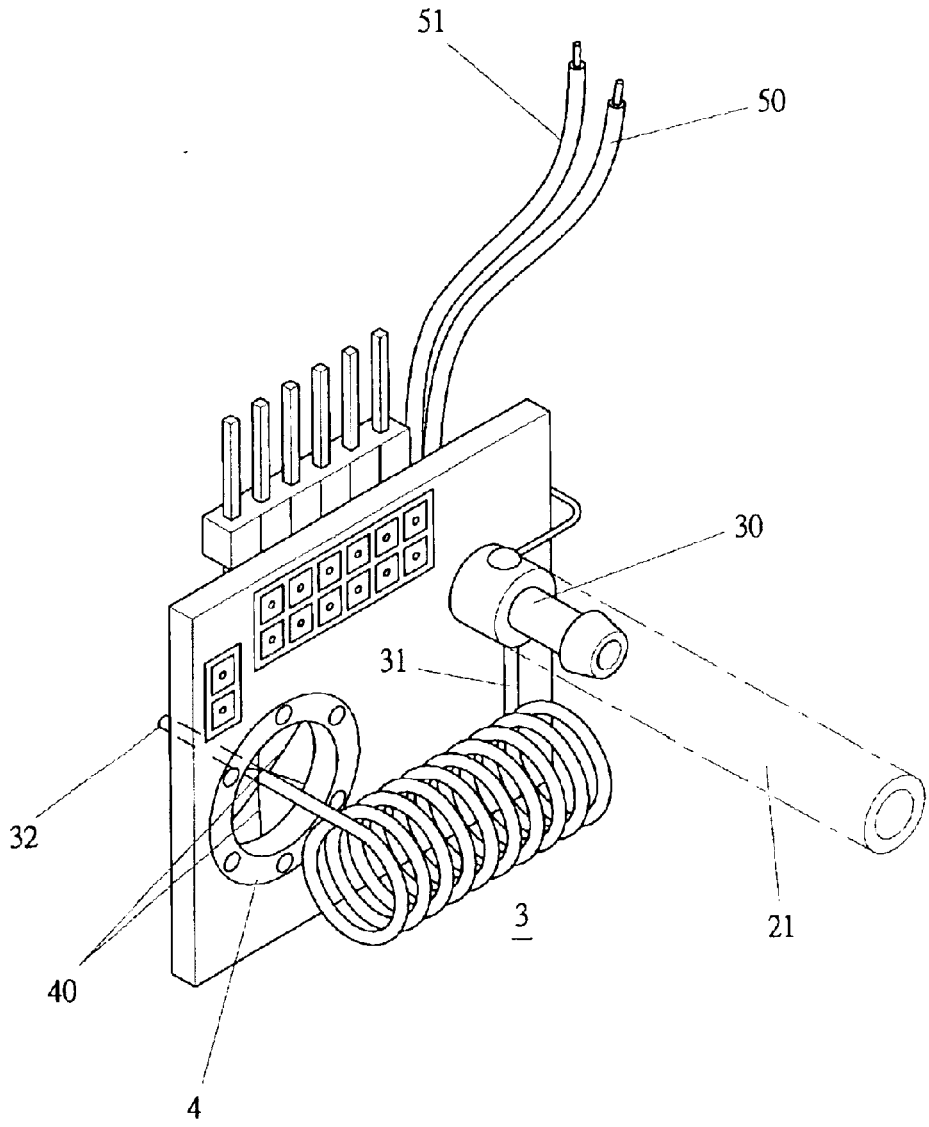
FIG. 3 is a perspective view of a helical heating tube in the present invention; and, FIG. 4 is a perspective view of vapor produced by the helical heating tube in the present invention.
Figure 4:
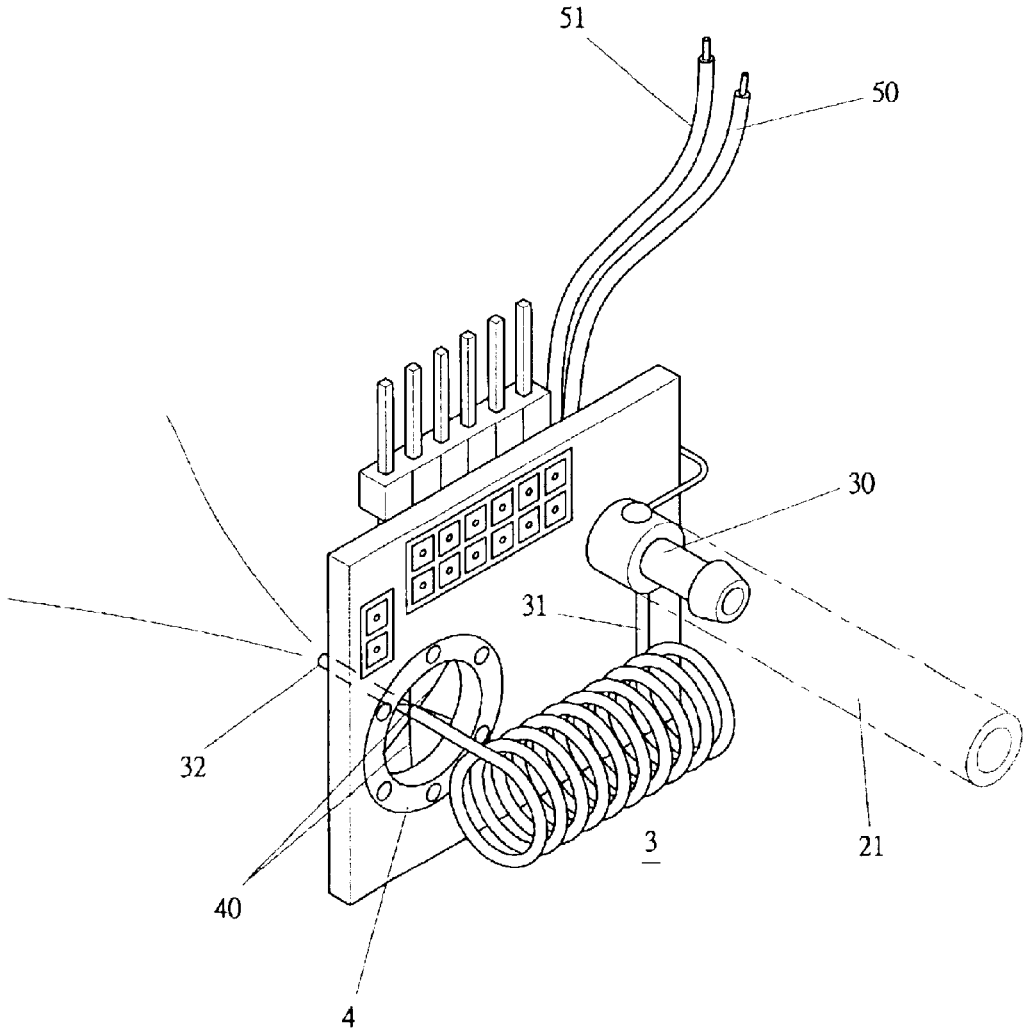

The heating tube 3 is shaped helical, having an inlet end 31 connected with a connect tube 30, and an outlet end 32 passing through a tube clamp 4 consisting of two leading wires 40 as shown in FIGS. 3 and 4. Then two electric wires 50,51 are respectively connected to the connect tube 30 and the tube clamp 4.

The control system 6 is used to control electric power to be supplied to the two electric wires 50,51 to electrify and heat up the heating tube 3 to directly heat up liquid therein quickly to high temperature so as to vaporizing liquid at the outlet end 32. In other words, instant electrifying carries out immediate heating to a proper temperature, boiling or vaporizing.

The helical heating tube 3 has an advantage that much liquid flows in the helical heating tube 3, the pump 2 produces pressure for pushing forward liquid in the heating tube 3, and vapor produced may be swiftly pushed out of the outlet end 32. On the other hand, liquid of room temperature flows at first in the helical heating tube 3 to keep the liquid in the inlet end 31 at the lowest temperature, increasing swiftly its temperature as it moves forward in the tube 3. Then the liquid may ultimately become vapor or boiled or reach to a proper temperature at the outlet end 32. Therefore, the temperature at the inlet end 31 is maintained low, preventing liquid in the tube 3 from flowing back to the pump 2, and consequently keeping smooth forward flowing of liquid in the heating tube 3. In addition, the liquid heating device in the invention does not have problems of drops occurring or of imperfect vaporization.

Therefore, the liquid heating device is applicable to a drinking water dispenser or a water heater or the like, owing to its function of heating liquid swiftly to boil, to vaporize, or to obtain proper temperature, worthy to be utilized in various industries.

While the preferred embodiment of the invention has been described above, it will be recognized and understood that various modifications may be made therein and the appended claims are intended to cover all such modifications that may fall within the spirit and scope of the invention.

What is claimed is:

1. A liquid heating device comprising:

a pump having an inlet tube fixed on a side for pumping liquid, and an outlet tube connected to a heating tube;

said heating tube having a connect tube connected to said outlet tube of said pump, said connect tube further connected to an inlet end of said heating tube, said heating tube further having an outlet end passing through a tube clamp consisting of plural leading wires; and, said inlet end and said outlet end of said heating tube respectively connected to two output terminals of a control system, said heating tube producing swiftly high heat to make liquid boil or reach a needed temperature or vaporize when powered by said control system, said liquid heated device having effect of immediately vaporizing liquid when powered.

* * * * *